US011280168B2

(12) United States Patent
Greci et al.

(10) Patent No.: US 11,280,168 B2
(45) Date of Patent: Mar. 22, 2022

(54) METHOD AND APPARATUS FOR INFLOW CONTROL WITH VORTEX GENERATION

(71) Applicant: Halliburton Energy Services, Inc., Houston, TX (US)

(72) Inventors: Stephen Michael Greci, Little Elm, TX (US); Michael Linley Fripp, Carrollton, TX (US); Pete Clement Dagenais, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/771,112

(22) PCT Filed: Feb. 21, 2018

(86) PCT No.: PCT/US2018/019051

§ 371 (c)(1),
(2) Date: Jun. 9, 2020

(87) PCT Pub. No.: WO2019/164483

PCT Pub. Date: Aug. 29, 2019

(65) Prior Publication Data

US 2021/0189847 A1 Jun. 24, 2021

(51) Int. Cl.

| | |
|---|---|
| ***E21B 43/12*** | (2006.01) |
| ***E21B 34/08*** | (2006.01) |
| *E21B 43/08* | (2006.01) |
| *E21B 43/32* | (2006.01) |

(52) U.S. Cl.

CPC ..... *E21B 43/12* (2013.01); *E21B 34/08* (2013.01); *E21B 43/08* (2013.01); *E21B 43/32* (2013.01)

(58) Field of Classification Search

CPC ..... E21B 43/12; E21B 43/32; E21B 43/08; E21B 34/08; F15D 1/00; F15D 1/0015

See application file for complete search history.

(56) References Cited

U.S. PATENT DOCUMENTS

| | | | |
|---|---|---|---|
| 8,517,099 | B2 | 8/2013 | Mathiesen et al. |
| 8,820,413 | B2 | 9/2014 | Mathiesen et al. |
| 8,820,414 | B2 | 9/2014 | Mathiesen et al. |
| 8,875,797 | B2 | 11/2014 | Aakre et al. |
| 9,038,649 | B2 | 5/2015 | Aakre et al. |
| 9,057,244 | B2 | 6/2015 | Øvland |
| 9,353,608 | B2 | 5/2016 | Johannessen |
| 9,534,470 | B2 | 1/2017 | Aakre et al. |
| 2009/0218103 | A1 | 9/2009 | Aakre et al. |

(Continued)

FOREIGN PATENT DOCUMENTS

| | | | |
|---|---|---|---|
| WO | 2011097101 | A1 | 8/2011 |

OTHER PUBLICATIONS

International Search Report and Written Opinion dated Nov. 19, 2018, International PCT Application No. PCT/US2018/019051.

*Primary Examiner* — George S Gray
(74) *Attorney, Agent, or Firm* — McGuire Woods LLP

(57) ABSTRACT

An inflow control device for controlling a production flow can include an inlet, a vortex chamber, and a flow control chamber. The inlet can extend obliquely relative to the central axis of the device. The vortex chamber can induce a vortical inflow from the inlet. The flow chamber can receive vortical inflow from the vortex chamber. A movable restriction disk within the flow control chamber can restrict the vortical inflow therein.

20 Claims, 6 Drawing Sheets

(56) References Cited

U.S. PATENT DOCUMENTS

| | | | | |
|---|---|---|---|---|
| 2012/0048561 | A1* | 3/2012 | Holderman | E21B 34/10 166/316 |
| 2013/0068467 | A1 | 3/2013 | Zhou | |
| 2013/0228341 | A1* | 9/2013 | Fripp | E21B 43/12 166/373 |
| 2014/0027126 | A1* | 1/2014 | Aakre | E21B 34/08 166/373 |
| 2016/0160616 | A1* | 6/2016 | Moen | F16K 25/005 166/244.1 |
| 2017/0002625 | A1 | 1/2017 | Chochua et al. | |

* cited by examiner

METHOD AND APPARATUS FOR INFLOW CONTROL WITH VORTEX GENERATION

TECHNICAL FIELD

The present description relates in general to inflow control devices, and more particularly, for example and without limitation, to methods and apparatuses for inflow control with vortex generation.

BACKGROUND OF THE DISCLOSURE

In hydrocarbon production wells, it is often beneficial to regulate the flow of formation fluids from a subterranean formation into a wellbore. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

BRIEF DESCRIPTION OF THE DRAWINGS

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

This section provides various example implementations of the subject matter disclosed, which are not exhaustive. As those skilled in the art would realize, the described implementations may be modified without departing from the scope of the present disclosure. Accordingly, the drawings and description are to be regarded as illustrative in nature and not restrictive.

The present description relates in general to inflow control devices, and more particularly, for example and without limitation, to methods and apparatuses for inflow control with vortex generation.

A number of devices are available for regulating the flow of formation fluids. Some of these devices are non-discriminating for different types of formation fluids and can simply function as a "gatekeeper" for regulating access to the interior of a wellbore pipe, such as a well string. Such gatekeeper devices can be simple on/off valves or they can be metered to regulate fluid flow over a continuum of flow rates. Other types of devices for regulating the flow of formation fluids can achieve at least some degree of discrimination between different types of formation fluids. Such devices can include, for example, tubular flow restrictors, nozzle-type flow restrictors, autonomous inflow control devices, non-autonomous inflow control devices, ports, tortuous paths, combinations thereof, and the like.

Autonomous inflow control devices (AICD) can be particularly advantageous in subterranean operations, since they are able to automatically regulate fluid flow without the need for operator control due to their design. In this regard, AICDs can be designed such that they provide a greater resistance to the flow of undesired fluids (e.g., gas and/or water) than they do desired fluids (e.g., oil), particularly as the percentage of the undesired fluids increases.

For example, AICDs can be utilized in formations with narrow oil pay zones that are driven by gas caps. In some applications, horizontal wellbores can allow for increased wellbore contact, but can increase the likelihood of gas breakthrough due to high formation permeability or proximity to a gas layer. A gas breakthrough can cause the loss of gas drive and/or cause an overrun of gas within the production tubing, preventing the production of residual oil. AICDs can be utilized to automatically choke back gas within the production tubing. In some applications, certain AICDs require a high production flow velocity to operate.

An aspect of at least some embodiments disclosed herein is the realization that by utilizing vortical flow within an inflow control device, lower production flow rates can be achieved while effectively choking back gas flow.

Figure 1:
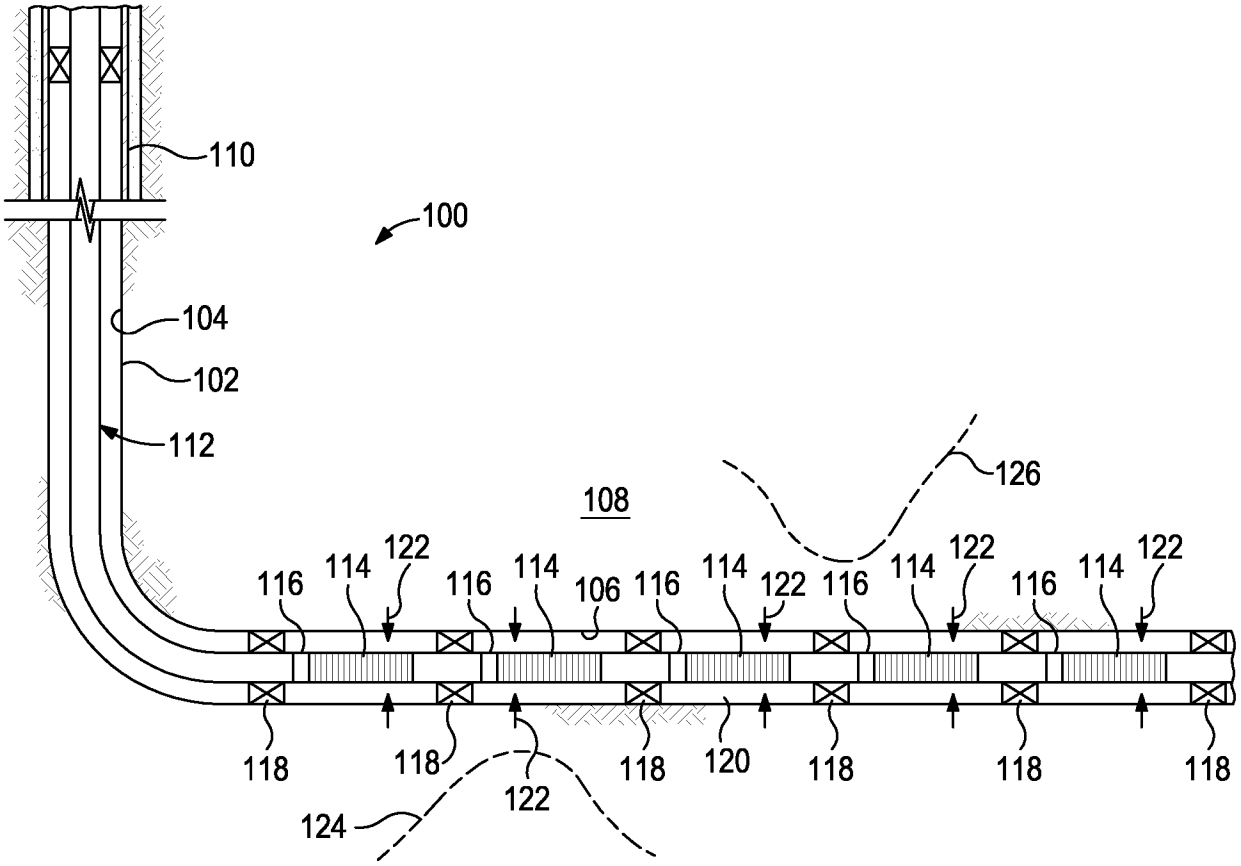
FIG. 1 is a cross-sectional view of a well system that can employ the principles of the present disclosure.

FIG. 1 is a cross-sectional view of a well system that can employ the principles of the present disclosure. As illustrated, the well system 100 may include a wellbore 102 that has a generally vertical uncased section 104 that transitions into a generally horizontal uncased section 106 extending through a subterranean earth formation 108. In some embodiments, the vertical section 104 may extend downwardly from a portion of the wellbore 102 having a string of casing 110 cemented therein. A tubular string, such as production tubing 112, may be installed in or otherwise extended into the wellbore 102.

One or more well screens 114, one or more flow control devices 116, and one or more packers 118 may be interconnected along the production tubular 112, such as along portions of the production tubular 112 in the horizontal section 106 of the wellbore 102. The packers 118 may be configured to seal off an annulus 120 defined between the production tubular 112 and the walls of the wellbore 102. As a result, fluids 122 may be produced from multiple intervals or "pay zones" of the surrounding subterranean formation 108 via isolated portions of the annulus 120 between adjacent pairs of the packers 118.

As illustrated, in some embodiments, a well screen 114 and a flow control device 116 may be interconnected in the production tubular 112 and positioned between a pair of packers 118. The well screens 114 may be swell screens, wire wrap screens, mesh screens, sintered screens, expandable screens, pre-packed screens, treating screens, or other known screen types. In operation, the well screen 114 may be configured to filter the fluids 122 flowing into the production tubular 112 from the annulus 120. The inflow control device 116 may be configured to restrict or otherwise regulate the flow of the fluids 122 into the production tubular 112, based on certain physical characteristics of the fluids.

It will be appreciated that the well system 100 of FIG. 1 is merely one example of a wide variety of well systems in which the principles of this disclosure can be utilized. Accordingly, it should be clearly understood that the principles of this disclosure are not necessarily limited to any of the details of the depicted well system 100, or the various components thereof, depicted in the drawings or otherwise described herein. For example, it is not necessary in keeping with the principles of this disclosure for the wellbore 102 to include a generally vertical wellbore section 104 or a generally horizontal wellbore section 106. Moreover, it is not necessary for fluids 122 to be only produced from the formation 108 since, in other examples, fluids could be injected into the formation 108, or fluids could be both injected into and produced from the formation 108, without departing from the scope of the disclosure.

Furthermore, it is not necessary that at least one well screen 114 and inflow control device 116 be positioned between a pair of packers 118. Nor is it necessary for a single inflow control device 116 to be used in conjunction with a single well screen 114. Rather, any number, arrangement and/or combination of such components may be used, without departing from the scope of the disclosure. In some applications, it is not necessary for a flow control device 116 to be used with a corresponding well screen 114. For example, in injection operations, the injected fluid could be flowed through a flow control device 116, without also flowing through a well screen 114.

It is not necessary for the well screens 114, flow control devices 116, packers 118 or any other components of the production tubular 112 to be positioned in uncased sections 104, 106 of the wellbore 102. Rather, any section of the wellbore 102 may be cased or uncased, and any portion of the production tubular 112 may be positioned in an uncased or cased section of the wellbore 102, without departing from the scope of the disclosure.

Those skilled in the art will readily recognize the advantages of being able to regulate the flow of fluids 122 into the production tubular 112 from each zone of the subterranean formation 108, for example, to prevent or control gas breakthrough into the production tubular 112 or gas coning 124 and/or water coning 126 in the formation 108. Other uses for flow regulation in a well include, but are not limited to, balancing production from (or injection into) multiple zones, minimizing production or injection of undesired fluids, maximizing production or injection of desired fluids, etc.

Figure 2:
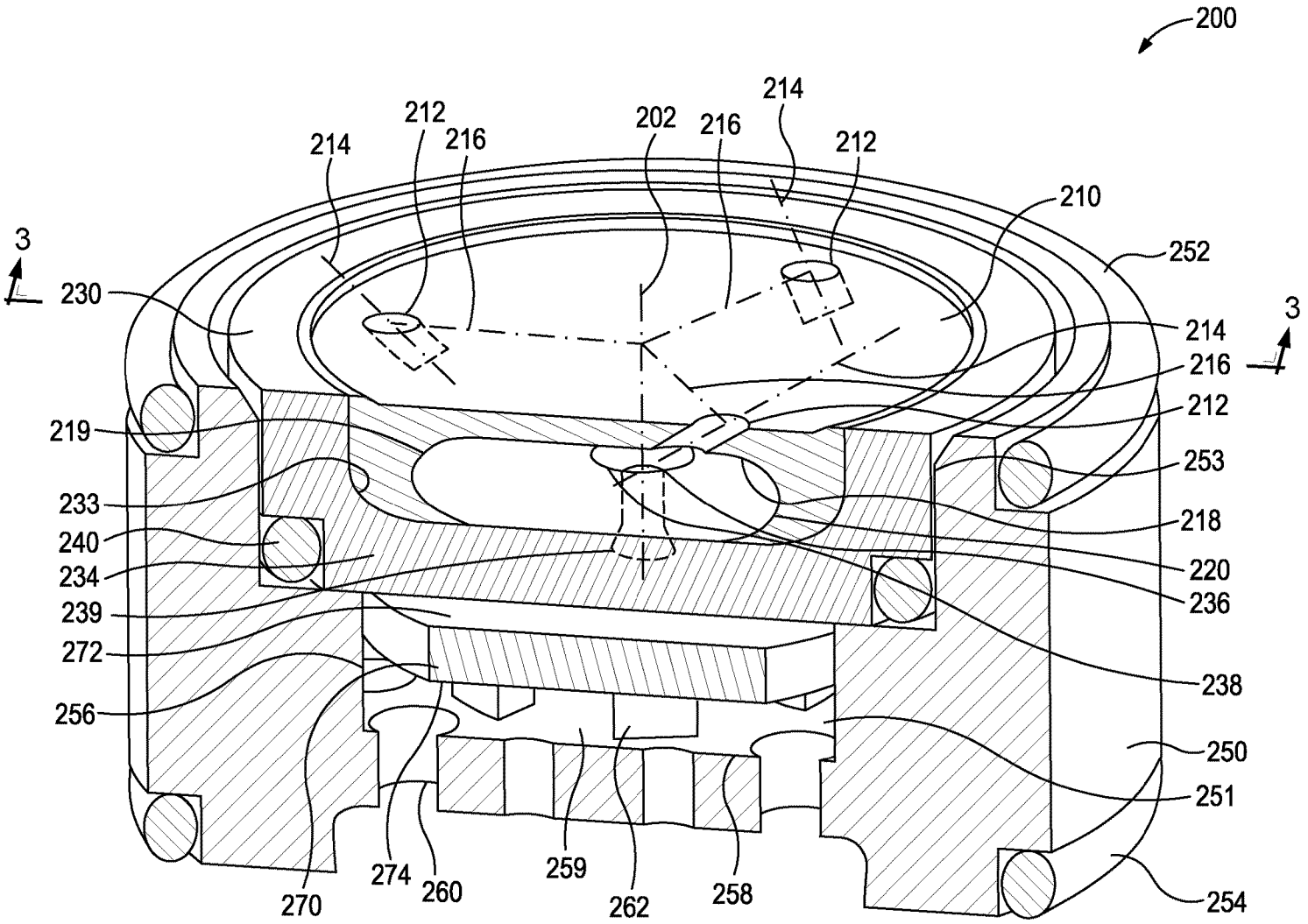
FIG. 2 is a perspective view with a partial cross-section of an inflow control device, according to some embodiments of the present disclosure.

FIG. 2 is a perspective view with a partial cross-section of an inflow control device, according to some embodiments of the present disclosure. In the depicted example, the inflow control device 200 selectively restricts gas flow and permits oil flow therethrough. The inflow control device 200 utilizes a lift force generated from the production flow to adjust the position of a restriction disk 270 within the inflow control device 200 to selectively restrict or permit the flow therethrough. The inflow control device 200 can be sealingly disposed within a production tubular, wherein an upper seal 252 and a lower seal 254 prevent uncontrolled flow past the flow control device 200.

In the depicted example, the inflow control device 200 utilizes a cyclone, cyclonic flow, a vortex, vortical inflow, or vortical flow to generate lift on the restriction disk 270. In some embodiments, vortical flow is generated within a vortex chamber 220. The vortex chamber 220 can include geometry or features that promote the whirling or swirling of flow therein to create vortical flow.

As illustrated, the vortex generator 210 and the vortex generator seat 230 define the vortex chamber 220. The vortex generator 210 is disposed within a vortex generator seat bore 233. Optionally, both the vortex generator 210 and the vortex generator seat 230 can have cylindrical shapes, wherein the vortex generator 210 concentrically fits within the vortex generator seat 230. The vortex generator 210 and the vortex generator seat 230 may sealingly fit together. The vortex generator walls 219 and the vortex surface 218 of the vortex generator 210 further define the vortex chamber 220.

In the depicted example, the vortex chamber 220 receives production flow through a plurality of inlets 212 extending through the vortex generator 210. The inlets 212 can have geometric properties to induce or provide vortical inflow to the production flow within the vortex generator.

Referring still to FIG. 2, the inlets 212 extend through the vortex generator 210 along an inlet axis 214. In some embodiments, the inlets 212 extend through the vortex generator 210 through the vortex generator walls 219 or through the upper vortex surface 218. Optionally, the inlets 212 can have inlet walls that are parallel to each other, forming a rhomboidal cross-sectional shape.

The inlets 212 can be of the same size or vary in size. In some embodiments, the inlets 212 can be tapered or flared through the vortex generator 210. Optionally, some inlets 212 are tapered or flared while other inlets 212 are not.

In the depicted example, the inlet axis 214 of the inlet 212 is oblique to the central axis 202. In some embodiments, the inlet axis 214 of the inlet 212 is angled relative to the central axis 202 along multiple planes, forming a compound angle between the inlet axis 214 and the central axis 202. Optionally, the inlet axis 214 is angled relative to the central axis 202 along one plane. Further, the inlet axis 214 can be parallel to the central axis 202 of the inflow control device 200.

Optionally, the vortex generator 210 includes multiple inlets 212. The vortex generator can include three inlets 212. The inlets 212 can be spaced apart. Further, the inlets 212 can be equidistantly spaced apart from each other. In some embodiments, the inlets 212 can be equidistantly spaced apart from the central axis 202 at an equal offset 216. In certain embodiments, the inlets 212 can be disposed at varying offsets 216 from the central axis 202.

In some embodiments, the inlets 212 can be disposed along a circular path or profile. The inlets 212 can have an inlet axis 214 that includes an orientation component that is tangential to the circumscribed circle formed by the inlets 212.

In the depicted example, the angle, size, shape, relative orientation, and number of inlets 212 are selected to create a desired a vortical flow within the vortex chamber 220. For example, the vortex chamber 220 can be cylindrical, frustroconical, and/or tapered. In some embodiments, the vortical flow has a tangential component due to the orientation of the inlets 212. Further, surfaces of the vortex chamber 220, such as the vortex generator walls 219 and the upper vortex surface 218 are curved, concave, and/or concave to promote the swirling of vortical flow therein.

In some embodiments, rotation of vortical flow through the vortex chamber 220 separates constituent fluids within the vortical flow. For example, denser fluids can be directed toward outer portions of the vortex chamber 220 while less dense fluids can be directed towards the center of the vortex chamber 220.

As shown, the position of the restriction disk 270 within the flow control chamber 251 is adjusted by the generated vortical flow from the vortex chamber 220 to selectively control flow therethrough.

As illustrated, the flow control body 250 and the vortex generator seat 230 define the flow control chamber 251. The vortex generator seat 230 is disposed within a flow control body bore 253. Further, the vortex generator seat 230 may concentrically fit within the flow control body 250. In some embodiments, a vortex generator seat seal 240 is disposed within the flow control body bore 253 between the vortex generator seat 230 and the flow control body 250 to sealingly engage the vortex generator seat 230 to the flow control body 250. As shown, a seat end portion 234 of the vortex generator seat 230, and a flow control cavity 259 of the flow control body 250 further defines the flow control chamber 251. The flow control cavity 259 includes the flow control cavity wall 256 and a flow control chamber end portion 258.

In the depicted example, the flow control chamber 251 receives vortical flow from the vortex chamber 220 through the vortexing passage 236. The vortexing passage 236 extends through the seat end portion 234 of the vortex generator seat 230 to provide fluid communication between the vortex chamber 220 and the flow control chamber 251. In some embodiments, the upper end 238 and/or the lower end 239 of the vortexing passage 236 is tapered or flared. The vortexing passage 236 can accelerate the vortical flow as the vortical flow passes therethrough.

In some embodiments, rotation of vortical flow through the vortexing passage 236 can also separate constituent fluids within the vortical flow. For example, denser fluids can be directed toward outer portions of the vortexing passage 236 while less dense fluids can be directed towards the center of the vortexing passage 236. In some applications, separation of constituent fluids can enhance the operation of the restriction disk 270 described herein.

As illustrated, the restriction disk 270 selectively restricts flow from the vortexing passage 236 to the flow control chamber 251. For example, flow into the flow control chamber 251 is restricted or choked by positioning the restriction disk 270 closer or adjacent to the vortexing passage 236. Similarly, flow into the flow control chamber 251 is increased by positioning the restriction disk 270 further away from the vortexing passage 246. At the lowest position the restriction disk 270 can rest upon disk stops 262 extending from the flow control chamber end portion 258.

In the depicted example, the restriction disk 270 is a generally circular disk. In some embodiments, the restriction disk 270 can have an oval shape. Optionally, the restriction disk 270 includes one or more orientation tabs slidingly engaged with the flow control body 250 to retain and/or orientate the restriction disk 270 within the flow control chamber 251.

In the depicted example, the vortical flow flows over and around the restriction disk 270 to generate an area of low pressure or a vacuum in the central portion of the restriction disk 270, to adjust the position of the restriction disk 270.

Further, the restriction disk 270 includes an upper or lift surface 272 and a lower surface 274. Vortical flow flows over and around the restriction disk 270 generating an area of low pressure at the lift surface 272, while a higher pressure remains at the lower surface 274, thereby generating lift. In some embodiments, the lift surface 272 includes curved surfaces to promote lift from vortical flow and/or to provide aerodynamic stability to reduce vibration or other unwanted movement.

In the depicted example, as net lift increases, the restriction disk 270 moves closer to the vortexing passage 236, restricting flow therethrough. As net lift is reduced, the restriction disk 270 moves further away from vortexing passage 236, reducing the restriction therethrough.

In the depicted example, the speed of the vortical flow affects net lift of the restriction disk 270, and therefore affects the position of the restriction disk 270 and the fluid restriction to the vortexing passage 236. For example, at a relative increased vortical flow speed, the restriction disk 270 provides greater flow restriction compared to lower vortical flow speeds.

Advantageously, the inflow control device 200 restricts the flow of faster flowing fluids while permitting the flow of slower moving fluids. The amount of rotation within the inflow control device 200 can vary with the properties of the fluid flowing therethrough. For example, a more viscous fluid may have less rotational velocity than a less viscous fluid. In another example, due to the relative low density of gas, gas flows quicker than oil. Therefore, when the vortical flow includes gas, the velocity of the vortical flow lifts the restriction disk 270, restricting flow therethrough, while when the vortical flow includes oil, the velocity of the vortical flow does not lift the restriction disk 270, permitting flow therethrough. In some embodiments, the mass of the restriction disk 270 can be selected or tuned to provide a desired restriction in response to fluid characteristics, such as density.

Restricted or controlled flow from the flow control chamber 251 flows through outlets 260. As shown, outlets 260 extend through the flow control chamber end portion 258 of the flow control chamber 251. In some embodiments, the outlets 260 are spaced apart and circularly disposed. Flow from the flow control chamber 251 may enter a production tubular.

Advantageously, vortical flow allows for increased net lift, allowing for more robust and erosion resistant components, such as the restriction disk 270. Further, by utilizing vortical flow, the critical fluid velocity to generate net lift on the restriction disk 270 and operate the flow control device 200 is relatively low. Therefore, in some embodiments, the overall flow rate within the wellbore can be reduced while permitting operation of the flow control device 200. In some applications, a lower operating flow rate can prevent gas breakthroughs.

Figure 3:
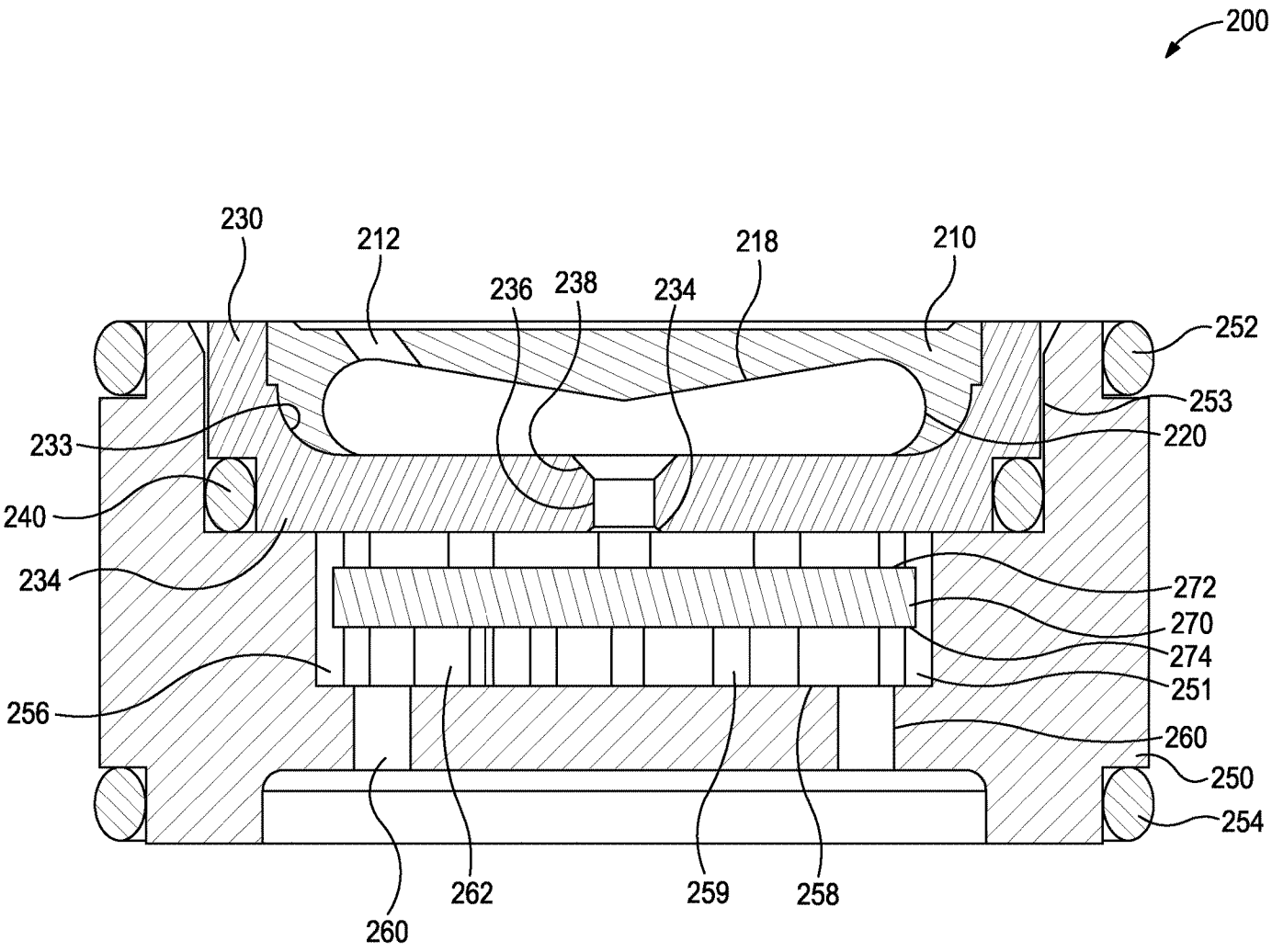
FIG. 3 is a cross-sectional view of the inflow control device of FIG. 2, in a flow position, according to some embodiments of the present disclosure.

FIG. 3 is a cross-sectional view of the inflow control device of FIG. 2, in a flow position, according to some embodiments of the present disclosure. In the depicted example, the vortical flow includes oil. As previously described, the relative velocity of vortical flow including oil may be slower than vortical flow including gas. Therefore, the relatively slower moving oil vortical flow may not generate sufficient lift to move the restriction disk 270 towards the vortexing passage 236, but instead repel the restriction disk 270 away from the vortexing passage 236 due to the momentum of the fluid exiting the vortexing passage 236. As a result, the restriction disk 270 permits unrestricted flow from the vortexing passage 236 as the restriction disk 270 is spaced apart from the vortexing chamber 236. Therefore, flow passes from the inlets 212, through the vortexing passage 236 and through the outlets 260 with minimal restriction.

Figure 4:
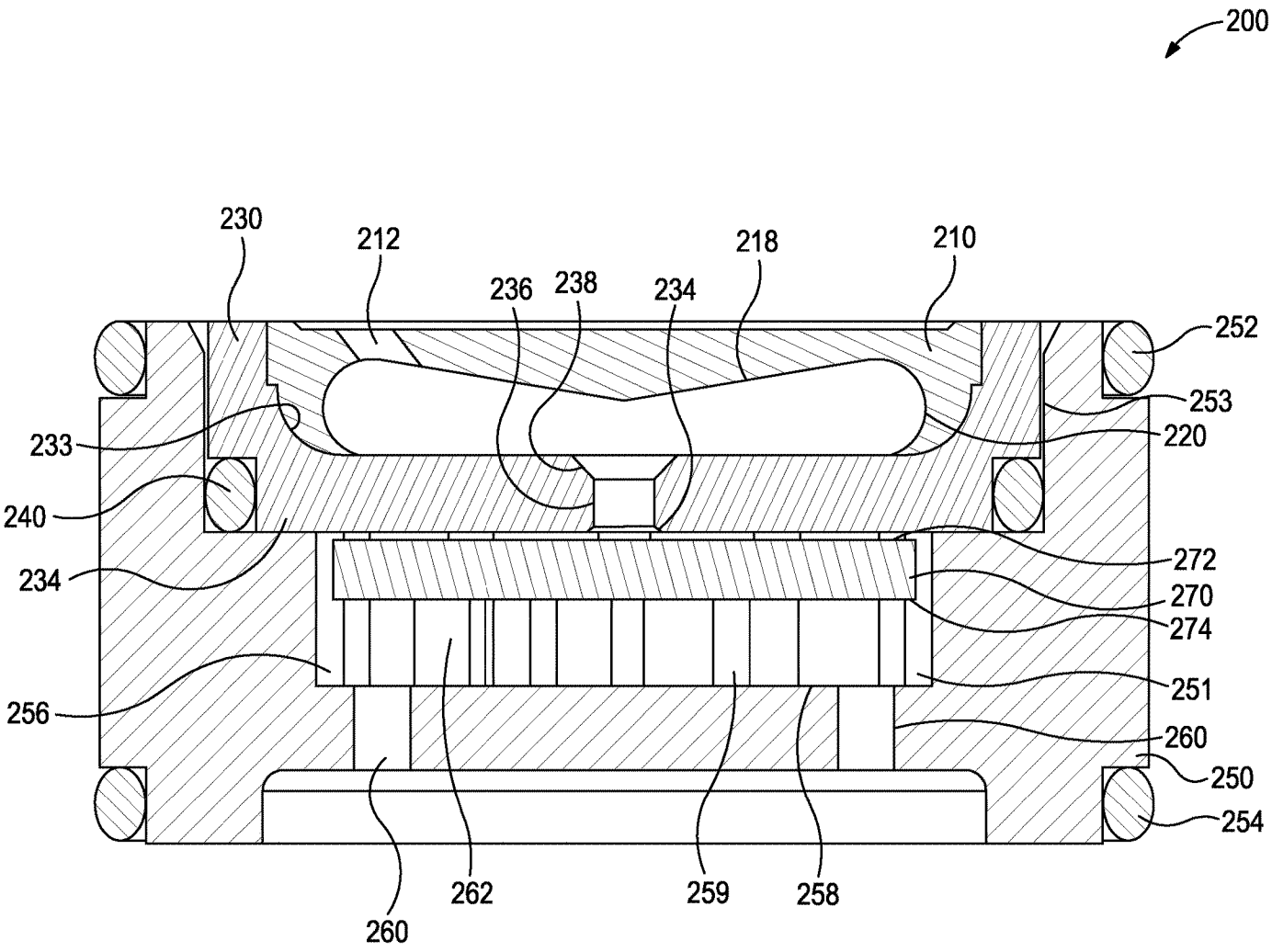
FIG. 4 is a cross-sectional view of the inflow control device of FIG. 2, in a restriction position, according to some embodiments of the present disclosure.

FIG. 4 is a cross-sectional view of the inflow control device of FIG. 2, in a restriction position, according to some embodiments of the present disclosure. Optionally, the vortical flow includes gas. As previously described, the relative velocity of vortical flow including gas may be faster than vortical flow including oil. Therefore, the relatively faster moving gas vortical flow can generate sufficient lift to move the restriction disk 270 towards the vortexing passage 236. As a result, the restriction disk 270 restricts flow from the vortexing passage 236 as the restriction disk 270 moves closer to the vortexing passage 236. Therefore, flow through the vortexing passage 236 and the flow control device 200 generally is restricted.

Figure 5:
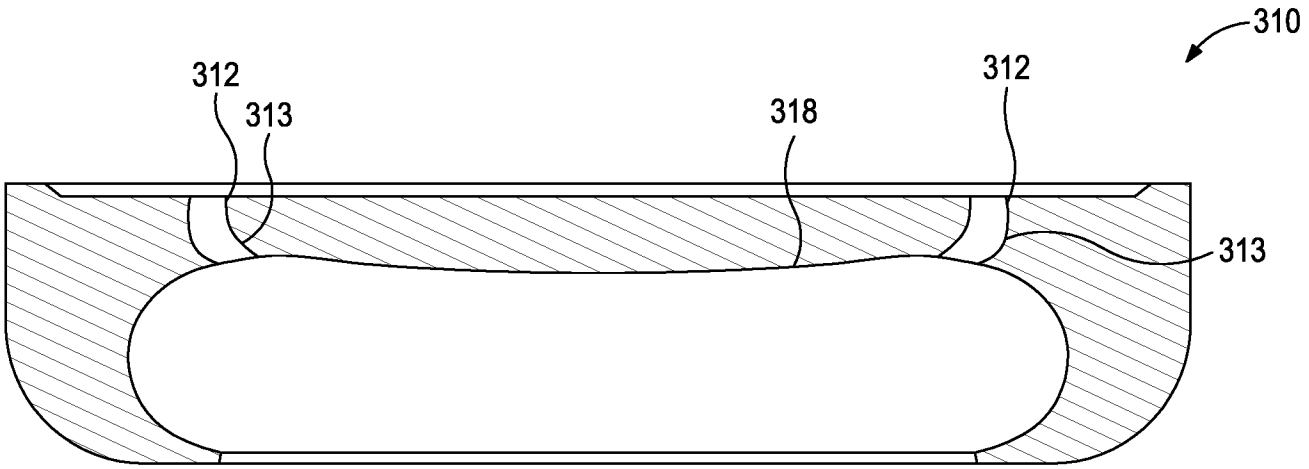
FIG. 5 is a cross-sectional view of a vortex generator, according to some embodiments of the present disclosure.

FIG. 5 is a cross-sectional view of a vortex generator, according to some embodiments of the present disclosure. In the depicted example, the vortex generator 310 includes inlets 312 extending through the vortex surface 318. During operation, the radiused bend 313 can redirect flow through the inlet 312 to facilitate vortical flow within the vortex chamber. The radius of the bend 313 can be selected to adjust the swirl and velocity of the vortical flow.

Figure 6:
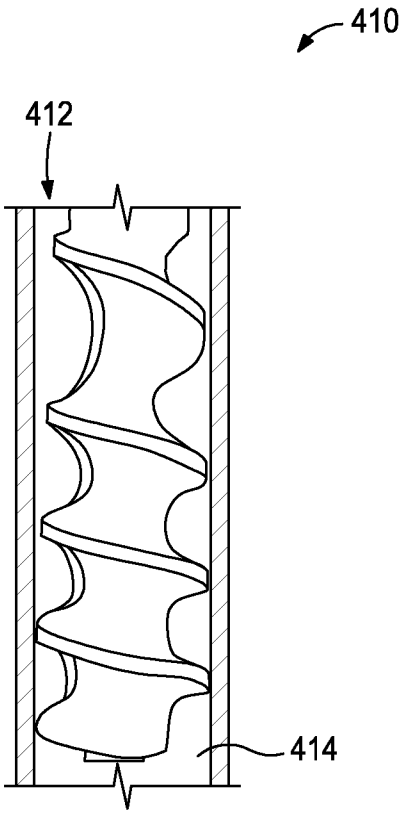
FIG. 6 is a cross-sectional view of a vortex generator, according to some embodiments of the present disclosure.

FIG. 6 is a cross-sectional view of a vortex generator, according to some embodiments of the present disclosure. In the depicted example, the vortex generator 410 includes a helical flow guide or vanes to rotate fluid flow therein. As illustrated, fluid flow introduced to inlet 412 is directed by the helical flow guide to impart rotation to the fluid flow, creating vortical flow therein. Vortical fluid flow can exit the vortex generator 410 at the outlet 414.

Various examples of aspects of the disclosure are described below as clauses for convenience. These are provided as examples, and do not limit the subject technology.

Clause 1. An inflow control device for controlling a production flow, the inflow control device comprising: a flow control body having a first bore, a flow control cavity, and a plurality of outlets in fluid communication with the flow control cavity, a movable restriction disk disposed within the flow control cavity and movable therewithin for restricting flow therethrough; a vortex generator seat positioned within the first bore of the flow control body above the flow control cavity, the vortex generator seat and the flow control cavity collectively defining a flow control chamber, the vortex generator seat having a second bore and a vortexing passage in fluid communication with the flow control chamber; and a vortex generator positioned within the second bore of vortex generator seat, the vortex generator having a vortex cavity and an inlet extending obliquely relative to a central axis of the vortex generator, the vortex generator and the vortex generator seat collectively defining a vortex chamber therebetween, the inlet in fluid communication with the vortex chamber to permit flow into the vortex chamber and induce vortical flow therewithin.

Clause 2. The inflow control device of Clause 1, wherein the inlet is disposed at a compound angle.

Clause 3. The inflow control device of Clauses 1 or 2, wherein the inlet includes a rhomboidal cross-sectional shape.

Clause 4. The inflow control device of any preceding Clause, wherein the inlet includes a radiused cross-sectional shape.

Clause 5. The inflow control device of any preceding Clause, wherein the inlet extends through a vortex generator wall of the vortex generator.

Clause 6. The inflow control device of any preceding Clause, wherein the plurality of angled inlets are disposed about a circle.

Clause 7. The inflow control device of Clause 6, wherein the plurality of angled inlets are tangential to the circle.

Clause 8. The inflow control device of any preceding Clause, wherein the inlet includes three inlets.

Clause 9. The inflow control device of any preceding Clause, wherein the vortex chamber includes an upper vortex surface.

Clause 10. The inflow control device of Clause 9, wherein the inlet is disposed through the upper vortex surface.

Clause 11. The inflow control device of any preceding Clause, wherein the movable restriction disk includes a lift surface.

Clause 12. The inflow control device of any preceding Clause, wherein the movable restriction disk includes an orientation tab received by the flow control chamber.

Clause 13. The inflow control device of any preceding Clause, wherein the movable restriction disk is circular.

Clause 14. The inflow control device of any preceding Clause, wherein the movable restriction disk is oval shaped.

Clause 15. The inflow control device of any preceding Clause, wherein the movable restriction disk includes a tunable mass.

Clause 16. The inflow control device of any preceding Clause, wherein the vortexing passage of the flow control chamber is tapered.

Clause 17. An inflow control device for controlling a production flow, the inflow control device comprising: an inlet extending obliquely relative to a central axis of the device; a vortex chamber in fluid communication with the inlet to permit flow into the vortex chamber and induce vortical flow therewithin; a vortexing passage in fluid communication with the vortex chamber to permit vortical outflow from the vortex chamber; a flow control chamber in fluid communication with the vortexing passage to permit vortical inflow into the flow control chamber; and a movable restriction disk disposed within the flow control chamber, the movable restriction disk being movable relative to the vortexing passage for restricting the vortical inflow into the flow control chamber.

Clause 18. The inflow control device of Clause 17, further comprising a flow control body and a vortex generator seat defining the flow control chamber.

Clause 19. The inflow control device of Clauses 17 or 18, further comprising a vortex generator and a vortex generator seat defining a vortex chamber.

Clause 20. The inflow control device of Clauses 17-19, wherein the inlet is disposed at a compound angle.

Clause 21. The inflow control device of Clauses 17-20, wherein the inlet includes a rhomboidal cross-sectional shape.

Clause 22. The inflow control device of Clauses 17-21, wherein the inlet includes a radiused cross-sectional shape.

Clause 23. The inflow control device of Clauses 17-22, wherein the inlet extends through a vortex chamber wall of the vortex chamber.

Clause 24. The inflow control device of Clauses 17-23, wherein the plurality of angled inlets are disposed about a circle.

Clause 25. The inflow control device of Clause 24, wherein the plurality of angled inlets are tangential to the circle.

Clause 26. The inflow control device of Clauses 17-25, wherein the inlet includes three inlets.

Clause 27. The inflow control device of Clauses 17-26, wherein the vortex chamber includes an upper vortex surface.

Clause 28. The inflow control device of Clause 27, wherein the inlet is disposed through the upper vortex surface.

Clause 29. The inflow control device of Clauses 17-28, wherein the movable restriction disk includes a lift surface.

Clause 30. The inflow control device of Clauses 17-29, wherein the movable restriction disk includes an orientation tab received by the flow control chamber.

Clause 31. The inflow control device of Clauses 17-30, wherein the movable restriction disk is circular.

Clause 32. The inflow control device of Clauses 17-31, wherein the movable restriction disk is oval shaped.

Clause 33. The inflow control device of Clauses 17-32, wherein the movable restriction disk includes a tunable mass.

Clause 34. The inflow control device of Clauses 17-33, wherein the vortexing passage of the flow control chamber is tapered.

Clause 35. A method for controlling a production flow from a wellbore, the method comprising: directing the production flow through a plurality of oblique inlets of an inflow control device into a vortexing chamber thereof to induce a vortical inflow through a vortexing passage into a flow control chamber of the inflow control device, the vortical inflow within the flow control chamber having an inflow pressure above a movable restriction disk disposed within the flow control chamber; and permitting the movable restriction disk to move within the flow control chamber relative to the vortexing passage in response to the inflow pressure, thereby allowing the movable restriction disk to restrict or permit flow through the vortexing passage.

Clause 36. The method of Clause 35, wherein the inflow pressure is configured to vary based on a vortical inflow velocity of the vortical inflow.

Clause 37. The method of Clause 36, wherein the vortical inflow velocity is based on a production flow velocity.

Clause 38. The method of Clause 37, wherein the vortical inflow velocity is faster than the production flow velocity.

Clause 39. The method of Clause 37, wherein the production flow velocity is based on a production flow pressure.

Clause 40. The method of Clause 39, further comprising adjusting the production flow pressure to adjust the production flow velocity.

Clause 41. The method of Clause 37, wherein the production flow velocity is based on a fluid density.

Clause 42. The method of Clause 41, further comprising restricting the vortical inflow through the vortexing passage based on fluid density.

Clause 43. The method of Clauses 35-42, wherein the permitting comprises permitting flow of an oil through the inflow control device.

Clause 44. The method of Clause 43, wherein the permitting comprises permitting the movable restriction disk to move away from the vortexing passage upon flow of oil through the inflow control device.

Clause 45. The method of Clauses 35-44, wherein the permitting comprises restricting flow of a gas through the inflow control device.

Clause 46. The method of Clause 45, wherein the permitting comprises allowing the movable restriction disk to move toward the vortexing passage.

Clause 47. The method of Clauses 35-46, further comprising directing the production flow to include a tangential flow component.

Clause 48. The method of Clauses 35-47, further comprising separating the production flow into a plurality of production flows.

Clause 49. The method of Clause 48, wherein the production flows are equidistantly spaced at separation.

Clause 50. The method of Clauses 35-49, further comprising forming the vortical inflow above the vortexing passage.

Clause 51. The method of Clauses 35-50, further comprising forming the vortical inflow below the vortexing passage.

Clause 52. The method of Clauses 35-51, further comprising accelerating the vortical inflow through the vortexing passage.

Clause 53. An inflow control device for controlling a production flow, the inflow control device comprising: an inlet extending obliquely relative to a central axis of the device; a flow control chamber in fluid communication with the inlet to permit flow and induce vortical inflow therewithin; and a movable restriction disk disposed within the flow control chamber, the movable restriction disk being movable relative the inlet for restricting the vortical inflow into the flow control chamber.

Clause 54. The inflow control device of Clause 53, further comprising a flow control body and a vortex generator seat defining the flow control chamber.

Clause 55. The inflow control device of Clauses 53 or 54, wherein the inlet is disposed at a compound angle.

Clause 56. The inflow control device of Clauses 53-55, wherein the inlet includes a rhomboidal cross-sectional shape.

Clause 57. The inflow control device of Clauses 53-56, wherein the inlet includes a radiused cross-sectional shape.

Clause 58. The inflow control device of Clauses 53-57, wherein the inlet is disposed equidistantly about a central axis.

Clause 59. The inflow control device of Clauses 53-58, wherein the inlet is disposed about a circle.

Clause 60. The inflow control device of Clause 59, wherein the inlet is tangential to the circle.

Clause 61. The inflow control device of Clauses 53-60, wherein the inlet includes three inlets.

Clause 62. The inflow control device of Clauses 53-61, wherein the movable restriction disk includes a lift surface.

Clause 63. The inflow control device of Clauses 53-62, wherein the movable restriction disk includes an orientation tab received by the flow control chamber.

Clause 64. The inflow control device of Clauses 53-63, wherein the movable restriction disk is circular.

Clause 65. The inflow control device of Clauses 53-64, wherein the movable restriction disk is oval shaped.

Clause 66. The inflow control device of Clauses 53-65, wherein the movable restriction disk includes a tunable mass.

Clause 67. The inflow control device of Clauses 53-66, wherein the vortexing passage of the flow control chamber is tapered.

What is claimed is:

1. An inflow control device for controlling a production flow, the inflow control device comprising:

a flow control body having a first bore, a flow control cavity, and a plurality of outlets in fluid communication with the flow control cavity;

a movable restriction disk disposed within the flow control cavity and movable therewithin for restricting flow therethrough;

a vortex generator seat positioned within the first bore of the flow control body above the flow control cavity, the vortex generator seat and the flow control cavity collectively defining a flow control chamber, the vortex generator seat having a second bore and a vortexing passage in fluid communication with the flow control chamber; and a vortex generator positioned within the second bore of vortex generator seat, the vortex generator having a vortex cavity and an inlet having an angled entry from a top surface of the vortex generator and extending obliquely relative to a central axis of the vortex generator, the vortex generator and the vortex generator seat collectively defining a vortex chamber therebetween, the inlets in fluid communication with the vortex chamber to permit flow into the vortex chamber and induce vortical flow therewithin.

2. The inflow control device of claim 1, wherein the inlet is disposed at an angle that is not perpendicular to the top surface of the vortex generator.

3. The inflow control device of claim 1, wherein the inlet includes a rhomboidal cross-sectional shape.

4. The inflow control device of claim 1, wherein the inlet includes a radiused cross-sectional shape.

5. The inflow control device of claim 1, wherein the inlet extends through a vortex generator wall of the vortex generator.

6. The inflow control device of claim 1, wherein the vortex chamber includes an upper vortex surface.

7. The inflow control device of claim 6, wherein the inlet is disposed through the upper vortex surface.

8. An inflow control device for controlling a production flow, the inflow control device comprising:

an inlet extending obliquely relative to a central axis of the device;

a vortex generator, wherein the inlet has an angled entry from a top surface of the vortex generator;

a vortex chamber in fluid communication with the inlet to permit flow into the vortex chamber and induce vortical flow therewithin;

a vortexing passage in fluid communication with the vortex chamber to permit vortical outflow from the vortex chamber;

a flow control chamber in fluid communication with the vortexing passage to permit vortical inflow into the flow control chamber; and a movable restriction disk disposed within the flow control chamber, the movable restriction disk being movable relative to the vortexing passage for restricting the vortical inflow into the flow control chamber.

9. The inflow control device of claim 8, further comprising a flow control body and a vortex generator seat defining the flow control chamber.

10. The inflow control device of claim 8, further comprising a vortex generator seat defining the vortex chamber.

11. The inflow control device of claim 8, wherein the inlet is disposed at an angle that is not perpendicular to the top surface of the vortex generator.

12. The inflow control device of claim 8, wherein the inlet includes a rhomboidal cross-sectional shape.

13. The inflow control device of claim 8, wherein the inlet includes a radiused cross-sectional shape.

14. The inflow control device of claim 8, wherein the inlet extends through a vortex chamber wall of the vortex chamber.

15. A method for controlling a production flow from a wellbore, the method comprising:

directing the production flow through an inlet having an angled entry from a top surface of a vortex generator of an inflow control device into a vortexing chamber thereof to induce a vortical inflow through a vortexing passage into a flow control chamber of the inflow control device, the vortical inflow within the flow control chamber having an inflow pressure above a movable restriction disk disposed within the flow control chamber; and permitting the movable restriction disk to move within the flow control chamber relative to the vortexing passage in response to the inflow pressure, thereby allowing the movable restriction disk to restrict or permit flow through the vortexing passage.

16. The method of claim 15, wherein the inflow pressure is configured to vary based on a vortical inflow velocity of the vortical inflow.

17. The method of claim 15, wherein the permitting comprises permitting flow of an oil through the inflow control device.

18. The method of claim 17, wherein the permitting comprises permitting the movable restriction disk to move away from the vortexing passage upon flow of oil through the inflow control device.

19. The method of claim 15, wherein the permitting comprises restricting flow of a gas through the inflow control device.

20. The method of claim 19, wherein the permitting comprises allowing the movable restriction disk to move toward the vortexing passage.

* * * * *